United States Patent [19]

Okazaki

[11] 4,415,321

[45] Nov. 15, 1983

[54] VANE COMPRESSOR HAVING A LIGHTWEIGHT ROTOR

[75] Inventor: Michio Okazaki, Konan, Japan

[73] Assignee: Diesel Kiki Co., Ltd., Saitama, Japan

[21] Appl. No.: 244,804

[22] Filed: Mar. 17, 1981

[30] Foreign Application Priority Data

Mar. 25, 1980 [JP] Japan ..... 55-36855

[51] Int. Cl.[3] ..... F04C 2/344

[52] U.S. Cl. ..... 418/179; 418/269; 29/156.4 R; 29/463; 419/29

[58] Field of Search ..... 418/179, 269, 270; 29/463, 156.4 R, 420

[56] References Cited

U.S. PATENT DOCUMENTS

| | | | |
|---|---|---|---|
| 2,636,667 | 4/1953 | Frei | 418/179 |
| 3,059,585 | 10/1962 | Froede et al. | 29/463 |
| 3,324,544 | 6/1967 | Haller | 29/420 |
| 3,884,601 | 5/1975 | Anthony | 418/179 |
| 3,988,079 | 10/1976 | Ounsted et al. | 29/156.4 R |
| 4,260,343 | 4/1981 | Watanabe et al. | 418/269 |

FOREIGN PATENT DOCUMENTS

| | | |
|---|---|---|
| 5541512 | 9/1953 | Japan . |
| 37-8794 | 4/1962 | Japan . |

OTHER PUBLICATIONS

Powder Metallurgy Advances, Roland P. Koehring, SAE Journal, Feb. 1963, pp. 39–41.

*Primary Examiner*—Andrew M. Dolinar
*Attorney, Agent, or Firm*—Frishauf, Holtz, Goodman and Woodward

[57] ABSTRACT

A vane compressor is provided which has a rotor formed therein with a plurality of axial slits opening in its outer peripheral surface in a circumferentially spaced arrangement, and in each of which a vane is received, and a plurality of cavities located between adjacent ones of the axial slits. The rotor is formed of at least two rotor elements integrally joined in an axial alignment, each rotor element being formed of a sintered alloy compact. The rotor elements are brazed along their end faces abutting against each other.

3 Claims, 13 Drawing Figures

VANE COMPRESSOR HAVING A LIGHTWEIGHT ROTOR

BACKGROUND OF THE INVENTION

This invention relates to a vane compressor for use in an air conditioner for automotive vehicles, and more particularly to improvements in the rotor used in a vane compressor of this kind for the purpose of reducing the weight of the rotor.

A vane compressor for use in an air conditioner for automobile vehicles is already known, e.g. from U.S. Pat. No. 3,834,846 issued Sep. 10, 1974, which is of the type including a rotary shaft arranged to be rotated by an associated prime mover; a rotor secured to the rotary shaft for rotation in unison therewith, the rotor having a plurality of axial slits formed in its outer peripheral surface; a plurality of vanes radially movably received in the axial slits; and a housing within which the rotor and the vanes are accommodated, the rotor, the vanes and the housing cooperating to define pump working chambers between them, wherein a refrigerant pumping action is carried out by the rotation of the rotor.

The rotor of such type vane compressor is machined from a carbon steel blank, and is formed therein with a central through bore extending along its axis, through which the rotary shaft extends, a back pressure chamber intersecting with the central through bore and having a diameter larger than the latter bore, and a plurality of vane-receiving axial slits extending substantially tangentially to the central through bore, opening in its outer peripheral surface and communicating with the back pressure chamber.

The rotor of such type is heavy in weight due to the presence of solid portions between adjacent ones of the axial slits, which results in consumption of a great deal of energy supplied from the prime mover in rotatively driving the rotor. Furthermore, the presence of the back pressure chamber with a diameter larger than that of the central through bore, renders the casting or machining operation of the rotor complicated and difficult to carry out.

OBJECTS AND SUMMARY OF THE INVENTION

It is a primary object of the invention to provide a vane compressor having a rotor which is devoid of solid portions between the vane-receiving axial slits but is formed therein with cavities located between the axial slits, thus being light in weight.

It is another object of the invention to provide a vane compressor having a rotor which is formed of at least two rotor elements joined in an axial alignment, and can therefore be manufactured with facility.

It is a further object of the invention to provide a method of manufacturing such rotors as mentioned in the preceding objects by means of compacting.

According to the present invention, there is provided a vane compressor comprising: a rotary shaft; a rotor secured on said rotary shaft for rotation in unison therewith, said rotor having a central through bore extending therethrough along an axis thereof and through which said rotary shaft extends, a plurality of axial slits formed in an outer peripheral surface thereof in a circumferentially spaced arrangement and extending along a whole length thereof, a back pressure chamber formed therein at an axially central portion thereof and intersecting with said central through bore, said back pressure chamber having a diameter larger than that of said central through bore, said plurality of axial slits having axially central portions thereof communicating with said back pressure chamber; and a plurality of cavities formed between adjacent ones of said axial slits; a plurality of vanes movably received in said axial slits; and a housing within which said rotor and said vanes are arranged, said housing cooperating with said rotor and said vanes to define pump working chambers therebetween; wherein said rotor comprises at least two rotor elements integrally joined in an axial alignment, said at least two rotor elements being each formed of a sintered alloy compact. Adjacent ones of the rotor elements have joining end faces thereof abutting against each other and joined by means of brazing with a brazing sheet member interposed between the joining end faces of the adjacent ones of the rotor elements.

According to the present invention, there is provided a method of manufacturing a rotor of the above-mentioned type, which comprises: preparing iron base metal powder containing copper; charging said metal powder into a plurality of molds each having a predetermined cavity shape; compressing said metal powder within said molds to form a plurality of green compacts having predetermined shapes; arranging said green compacts in an abutting manner so as to form the shape of said rotor and simultaneously applying at least one brazing member to said green compacts along at least one abutting portion thereof; heating said green compacts and said brazing member under a reducing atmosphere to cause said green compacts to be integrally joined to obtain an integral piece of sintered alloy compacts, and finish grinding surfaces of said piece.

The above and other objects, features and advantages of the invention will be more apparent upon reading the ensuing detailed description taken in connection with the accompanying drawings in which:

DETAILED DESCRIPTION

Figure 1:
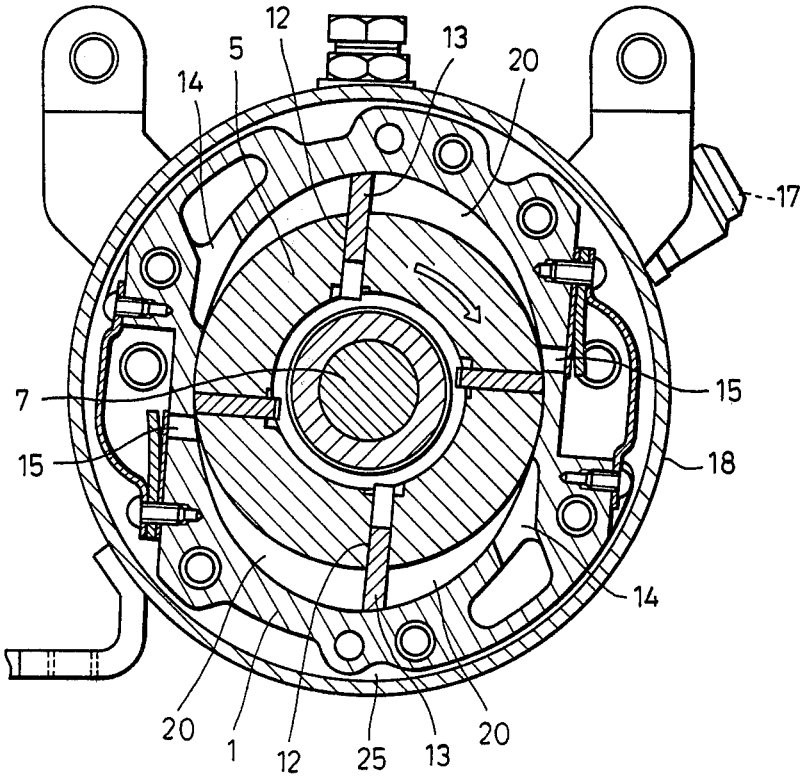
FIG. 1 PRIOR ART
FIG. 1 is a cross sectional view of a conventional vane compressor.
Figure 2:
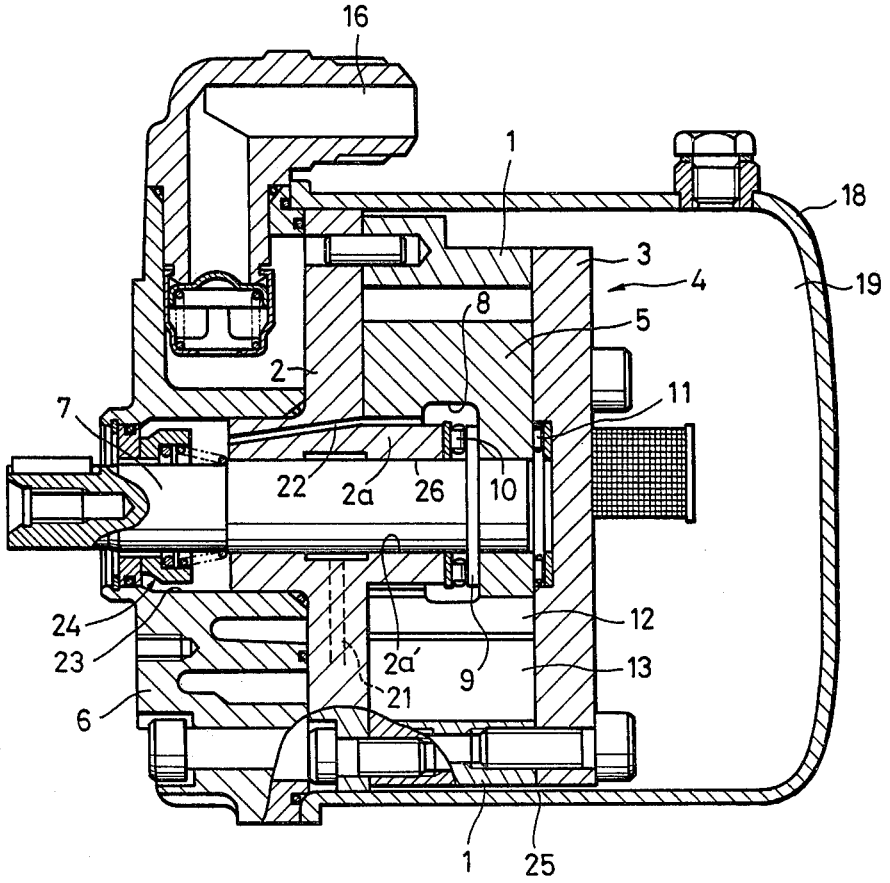
FIG. 2 PRIOR ART
FIG. 2 is a longitudinal sectional view of the vane compressor of FIG. 1.

A conventional vane compressor is illustrated in FIGS. 1 and 2. A cam ring 1 having an oblong cross section is combined at its opposite ends with front and rear blocks 2, 3 which are secured to the cam ring 1 to form a pump housing 4 in cooperation therewith. A rotor 5 having a circular cross section is rotatably disposed within the pumpt housing 4. The rotor 5 is rigidly fitted on a rotary shaft 7 which penetrates the front block 2 and a front head 6 secured to a front end face of the front block 2. The rotary shaft 7 is rotatably supported by a bearing portion 2*a* formed integrally on the front block 2. The rotor 5 is formed therein with a back pressure chamber 8 within which is disposed a collar 9 radially projecting from the rotary shaft 7. A thrust bearing 10 is interposed between the collar 9 and the bearing portion 2*a* of the front block 2, and another thrust bearing 11 between the rotor 5 and the rear block 3, respectively, to support axial forces or thrust loads caused by the rotor 5 and maintain the clearances between the rotor 5 and the two blocks 2, 3 at respective predetermined values. The rotor 5 is formed with a plurality of axial slits 12 (only one of them is shown) radially opening in its peripheral lateral surface and circumferentially spaced from each other at equal intervals, in which a plurality of plate-like vanes 13 are radially movably fitted. The cam ring 1 is formed with refrigerant inlets 14 and outlets 15 communicating, respectively, with the refrigerant suction port 16 and delivery port 17 of the compressor. A cover 18 is mounted on the front head 6 in a fashion enclosing the pump housing 4 to define a refrigerant delivery chamber 19 between the cover 6 and the pump housing 4. The refrigerant outlets 15 communicate with the refrigerant delivery port 17 via this delivery chamber 19.

With this arrangement, when the rotor 5 is rotated by the rotation of the rotary shaft 7 which is connected to the drive shaft of a prime mover, not shown, the vanes 13 carried by the rotor 5 are moved radially outwardly due to a centrifugal force produced by the rotation of the rotor 5 to slide on the inner peripheral surface of the cam ring 1 in a manner being pressed against it. Each time one of the vanes 13 passes each of the inlets 14 formed in the wall of the cam ring 1, a pump working chamber 20, which is defined between the above-mentioned vane, the next or immediately following vane and the rotor, comes into the suction stroke wherein it increases in volume to aspirate refrigerant. During the delivery stroke, the chamber 20 decreases in volume to discharge pressurized refrigerant through the outlets 15, thus carrying out a pumping action.

The back presssure chamber 8 formed within the rotor 5 communicates, on one hand, with a lubricating oil supply passage 21 formed in the front block 2 via a gap 26 between a through bore 2*a'* formed in the bearing portion 2*a*, through which the rotary shaft 7 extends, and the rotary shaft 7, and on the other hand, with a space 23 formed within the front head 6 via a passage 22 extending in the rotor 5 and through the front block 2. This space 23 accommodates a shaft sealing means 24 sealingly fitted on the rotary shaft 7. The above-mentioned lubricating oil supply passage 21 communicates with the delivery chamber 19 via a gap 25 formed between the lower portion of the cam ring 1 and the bottom of the cover 18.

During the rotation of the rotor 5, the pressure within the delivery chamber 19 is so high that lubricating oil stored on the bottom of the chamber 19 is made to travel through the gap 25, the supply passage 21 and the gap 26 and, on one hand, is supplied into the space 23 to lubricate the shaft sealing means 24, and, on the other hand, is guided into the back pressure chamber 8 where it applies back pressure to the vanes 13 to urge them against the inner peripheral surface of the cam ring 1, and also lubricates the thrust bearing 9.

Figure 3:
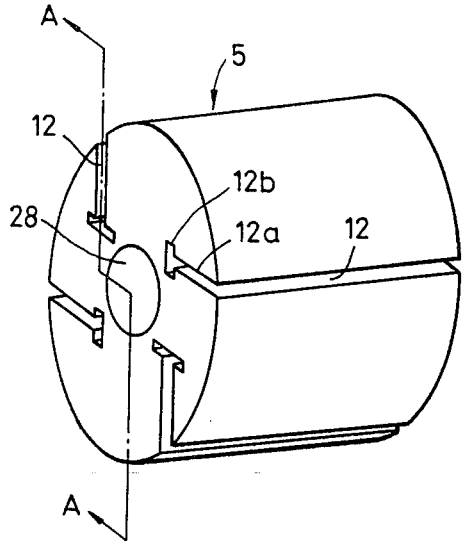
FIG. 3 is a perspective view of a rotor used in the vane compressor of FIG. 1.
Figure 4:
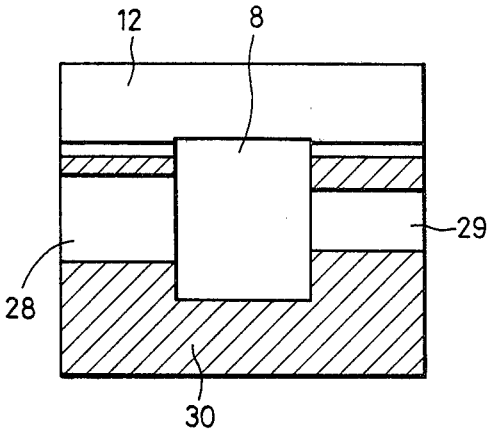
FIG. 4 is a sectional view taken on line A—A in FIG. 3.

FIGS. 3 and 4 illustrate the rotor 5 used in the vane compressor in FIGS. 1 and 2. The rotor 5, which is usually formed by machining a carbon steel blank, includes a first central bore 28 extending along the axis of the rotor 5, in which the bearing portion 2*a* of the front black 2 is to be fitted, a second central bore 29 also extending along the axis of the rotor, in which the top end of the rotary shaft 7 is to be fitted, a back pressure chamber 8 formed in an axially central portion of the rotor in a fashion intersecting with the central bores 28, 29 in concentricity therewith, and having a diameter larger than those of the central bores 28, 29, and a plurality of axial slits 12 formed in the outer peripheral surface of the rotor 5 in a fashion extending substantially tangentially to the central bores 28, 29, in which the vanes 13 in FIGS. 1 and 2 are to be fitted.

The axial slits 12 each extend along the whole length of the rotor 5 and have a first portion 12*d* opening in the outer peripheral surface of the rotor 5 and a second portion 12*b* intersecting with an inner end of the first portion 12*a* perpendicularly thereto. The slits 12 communicate at their axially central portions with the back pressure chamber 8.

Rotors for use in vane compressors in general should desirably be light in weight in the light of the necessity of obtaining a high refrigerant compression efficiency of the compressors and the production convenience of the rotors. However, the rotor illustrated, which is used in general in conventional vane compressors, has superfluous solid portions 30 located between adjacent axial slits 12, which renders the rotor heavy in weight. Further, the rotor is very complicated in structure and difficult to manufacture due to the presence of the back pressure chamber 8 having a diameter larger than those of the central bores 28, 29.

FIGS. 5 through 9 illustrate rotors for use in vane compressors according to preferred embodiments of the present invention. In these figures, parts or elements corresponding to those in FIGS. 1 through 4 are designated by like reference numerals.

Figure 5:
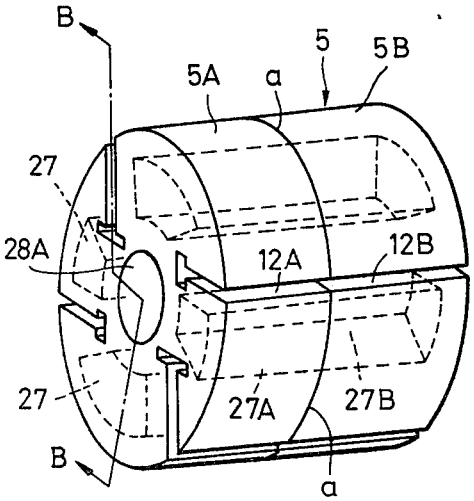
FIG. 5 is a perspective view of a rotor according to a first embodiment of the present invention.
Figure 6:
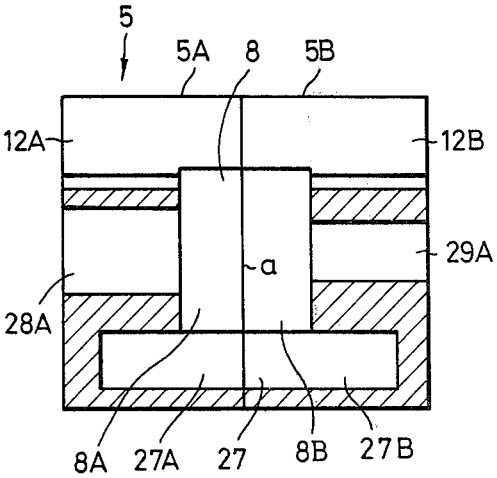
FIG. 6 is a sectional view taken on line B—B in FIG. 5.

FIGS. 5 and 6 illustrate a rotor according to a first embodiment of the present invention. The rotor 5 is formed of a cylindrical member and is made of a sintered alloy compact. This rotor 5 is divided at its axially central portion in a direction perpendicular to its axis, in a first rotor element 5A and a second rotor element 5B. The two rotor elements 5A, 5B comprise generally cylindrical bodies having configurations substantially similar to each other and are integrally joined in an axial alignment. The elements 5A, 5B are formed, respectively, with first and second central bore forming spaces 28A, 29A extending from their respective outer end faces along their axes, and back pressure forming spaces 8A, 8B intersecting with their respective central bore forming spaces 28A, 29A in concentricity therewith, and opening in the respective joining inner end faces of the elements, the spaces 8A, 8B having diameters larger than those of the spaces 28A, 29A. The rotor elements 5A, 5B are further formed, respectively, with axial slit forming spaces 12A, 12B opening in their respective outer peripheral surfaces and extending substantially tangentially to the central bore forming spaces 28A, 29A. These axial slit forming spaces 12A, 12B communicate at their inner ends with the respective back pressure chamber forming spaces 8A, 8B. Each pair of axial slit forming spaces 12A, 12B is to receive a vane, not shown. Cavity forming spaces 27A, 27B are formed between adjacent axial slit forming spaces 12A, 12B, which extend axially of the rotor elements and open in the respective joining inner end faces of the rotor elements, in communication with the respective back pressure chamber forming spaces 8A, 8B. Consequently, the rotor has therein a substantially single space having a large total volume, i.e., the substantially single space being made up of spaces 8A, 8B, 12A, 12B, 27A and 27B.

The rotor 5 according to the present invention, which is manufactured from a sintered alloy by means of compacting in molds, can facilitate its manufacture due to forming same of the two rotor elements 5A, 5B having the above-described structures.

Figure 7:
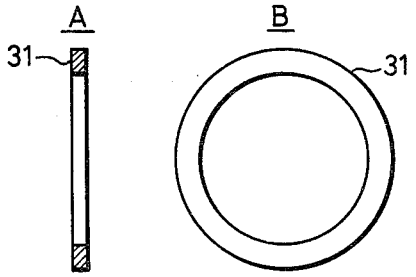
FIGS. 7 A and B are a sectional view and a front view, respectively, of a brazing member used for joining of rotor elements such as ones illustrated in FIGS. 5, 6.

The manner of manufacturing the rotor 5 will now be described. First, the right and left rotor elements 5A, 5B are formed in separate compacts by using molds. Metal power is prepared which has a composition consisting essentially of 2–4 percent by weight, preferably 3 percent by weight copper, 0.5–1 percent by weight, preferably 0.7 percent by weight carbon, and the balance of iron and inevitable impurities. The metal powder is charged into two molds each having a predetermined cavity shape. The metal powder thus charged into the molds is compressed under pressure within a range of 3–7 tons/cm$^2$ to obtain two green compacts each having a predetermined shape. After being removed from the molds, the two green compacts are arranged in an abutting manner so as to assume the shape of a rotor, with an annular brazing sheet member 31 as illustrated in FIGS. 7 A and B intervening between the two green compacts along their joining abutting end faces. The brazing sheet member 31 may be formed of a compact consisting essentially of 99 percent or more copper or a casting having the same composition. The abutting two green compacts and the brazing sheet member are heated under a reducing atmosphere at a temperature within a range of 1,000°–1,300° C., preferably 1,200° C. for 30 minutes–2 hours, to cause the green compacts to be integrally joined. The resulting piece of sintered alloy compacts has a sintered density within a range of 6–7 gr/cm$^2$, preferably 6.7 gr/cm$^2$. The piece of sintered alloy compacts has its surfaces subjected to finish grinding into a rotor 5.

In FIGS. 5, 6, the solid line a indicates the joining seam of the rotor elements 5A, 5B at which seam the brazing member 31 is interposed between the rotor elements 5A, 5B.

Figure 8:
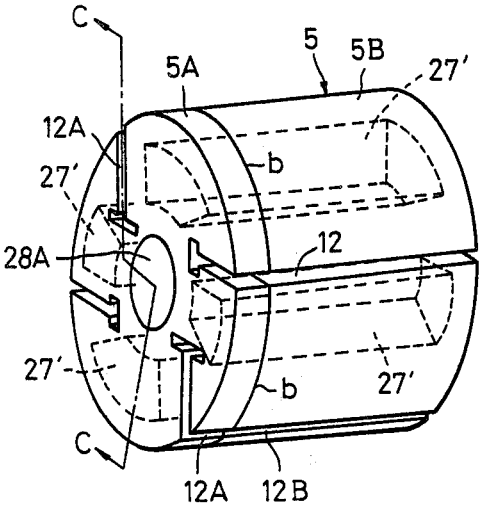
FIG. 8 is a perspective view of a rotor according to a second embodiment of the present invention.
Figure 9:
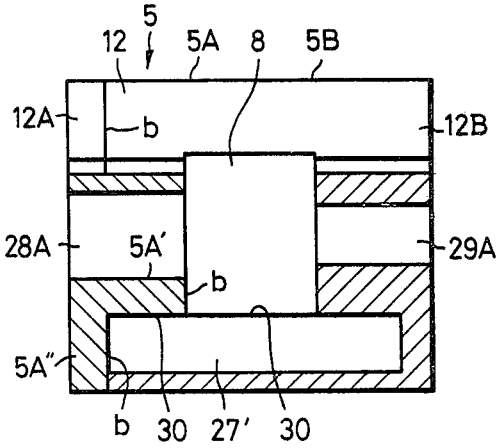
FIG. 9 is a sectional view taken on line C—C in FIG. 8.

FIGS. 8 and 9 illustrate a rotor according to a second embodiment of the invention. According to this embodiment, the two rotor elements do not abut against each other along an axially central portion of the rotor 5. One of the rotor elements, i.e., the rotor element 5A is formed of a plate-like body having a boss 5A' extending along the whole length of the element 5A and formed with a first central bore forming space 28A axially extending therethrough, and a flange 5A' radially outwardly extending from the outer end portion of the boss 5A'. The rotor element 5A is further formed with a plurality of axial slit forming spaces 12A opening in the outer peripheral surface of the flange 5A''. The other rotor element 5B is formed of a generally cylindrical body which is formed therein with a second central bore forming space 29A extending from the outer end face of the element 5B along its axis, and a back pressure chamber forming space 30 having a diameter larger than that of the central bore forming space 29A and intersecting with the latter space 29A in concentricity therewith, the space 30 opening in the inner end face of the rotor element 5B facing the other element 5A. Further formed between adjacent axial slit forming spaces 12A are cavity forming spaces 27' opening in the above inner end face of the element 5B and communicating with the space 30.

Figure 10:
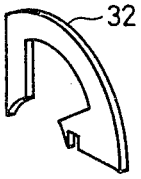
FIG. 10 is a perspective view of a brazing member used for joining of rotor elements such as ones illustrated in FIGS. 8, 9.

These rotor elements 5A, 5B are combined with each other by means of brazing in such a manner that the boss 5A' of the rotor element 5A is inserted in the space 30 of the other rotor element 5B with the inner end face of the flange 5A'' abutting against the associated end face of the element 5A. The back pressure chamber 8 is defined by the space 30 and the boss 5A' of the rotor element 5A. Four brazing sheet members 32 are interposed between the abutting inner end faces of the two elements 5A, 5B, the peripheral edges of which appear on the outer peripheral surface of the rotor 5 as indicated by the solid line b in FIGS. 8, 9. The sintering and brazing conditions similar to those previously mentioned with respect to the embodiment in FIGS. 5, 6 can apply to the present embodiment as well, but in the present embodiment, the brazing sheet members 32 each have a shape illustrated in FIG. 10. The brazing sheet members 32 are circumferentially arranged side by side and applied between the two rotor elements 5A, 5B. Each brazing sheet member 32 has a shape corresponding to part of the joining end faces of the rotor elements 5A, 5B which is obtained by dividing them in four at circumferentially equal intervals.

Even with the rotor elements 5A, 5B configurated as described above, removal of the green compacts from their respective molds can be done with ease.

Figure 11:
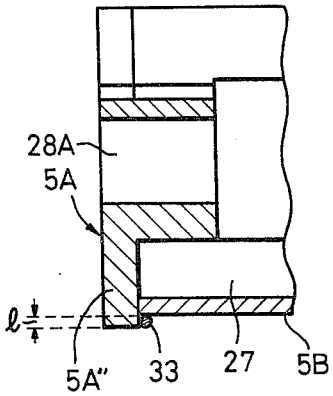
FIG. 11 is a fragmentary sectional view of a rotor according to a third embodiment of the present invention.
Figure 12:
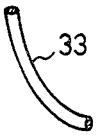
FIG. 12 is a perspective view of a brazing member for use in brazing of the rotor elements in FIG. 11.

FIG. 11 illustrates a rotor according to a third embodiment of the invention. This embodiment is distinguished from the embodiment in FIGS. 8, 9 in that the left rotor element 5A, which corresponds to left one illustrated in FIGS. 8, 9, has a flange 5A'' lengthened so as to slightly protrude radially outwardly with respect to the outer peripheral surface of the other rotor element 5B, by an amount l. Further, four brazing members 33 (only one of them is shown in FIG. 11) each in the form of an arcuate bar as illustrated in FIG. 12 are used for brazing of the two rotor elements 5A, 5B. Each brazing member 33 is applied on the elements 5A, 5B along the outer peripheral edges of the abutting end faces thereof and in contact with the inner end face of the projecting portion of the flange 5A'' of the element 5A and an adjacent portion of the outer peripheral surface of the element 5B. Each brazing member 33 is disposed on the elements 5A, 5B in a manner extending circumferentially of the elements 5A, 5B over each portion of their outer peripheral surfaces intervening between adjacent axial slit forming spaces of them.

According to this embodiment, the inner end face of the flange 5A'' of the rotor element 5A and the inner end of the other element 5B directly abuts against each other with no substantial portions of the brazing members 33 interposed between the mutually facing end faces of the flange 5A'' and the inner end of the element 5 B. Therefore, the brazing members 33 do not have their portions present in the cavities 27 formed within the brazed rotor elements 5A, 5B. Thus, such a phenomenon can be avoided that part of the brazing members stuck to the inner end face of the flange 5A" in the cavities 27 falls off due to back pressure produced within the back pressure chamber 8 or vibration of the rotor 5, to be guided into the thrust bearing 9 within the back pressure chamber 8, the gaps between the axial slits 12 and the vanes 13, or the gaps between the bearing portion 2*a* of the front block 2 end the drive shaft 7 to impede smooth actions of these parts.

The two rotor elements 5A, 5B are joined by means of brazing during sintering of the green compacts for formation of such elements under the same conditions as those applied to the previously described embodiments. After the above brazing, the outwardly projecting portion of the flange 5A" is cut off so that the flange 5A" has its outer peripheral surface flush with the outer peripheral surface of the rotor element 5B. During the brazing members 33 are melted and partially flow into the gaps between the flange 5A" of the rotor element 5A and the inner end of the rotor element 5B. The portions of the brazing members 33 which are exposed to the outside of the elements are removed together with the projecting portion of the flange 5A" during the cutting operation of the latter.

To prepare the rotor elements 5A, 5B in FIG. 11, two green compacts having shapes generally corresponding, respectively, to those of the rotor elements 5A, 5B shown in FIGS. 8, 9 are formed under the same conditions as those applied to the first embodiment previously described, but the green compact for the element 5A has a diameter at its flange slightly larger than the diameter of the green compact for the element 5B so that the flange 5A" of the rotor element 5A thus obtained has its outer peripheral surface slightly radially outwardly projected with respect to the associated outer peripheral surface of the rotor element 5B joined with the element 5A. These green compacts are made to abut against each other at their end faces in the same manner as mentioned with reference to the embodiment in FIGS. 8, 9. Then, brazing members 33 as illustrated in FIG. 12 are applied on the outer peripheral surfaces of the green compacts along the outer peripheral edges of the abutting end faces thereof and in contact with the inner end face of the projecting portion of the flange of the compact for the element 5A and the associated outer peripheral surface of the outer compact for the element 5B. Then, the two green compacts and the brazing members 33 are subjected to heating under the same conditions as those described with reference to the first embodiment, to obtain an integral piece of rotor elements 5A, 5B. Thereafter, the projecting portion of the flange 5A" of the element 5A is cut off as described above, followed by subjecting the joined elements 5A, 5B to finish grinding of the surfaces thereof.

In the embodiments illustrated in FIGS. 8, 9 and 11, it is noted that the rotor element 5A on the side of the front block 2 is shorter than the other rotor element 5B. However, alternatively, the other rotor element 5B on the side of the rear block 3 may be configurated shorter than the rotor element 5A.

Obviously many modifications and variations of the present invention are possible in the light of the above disclosure. It is therefore to be understood that within the scope of the appended claims, the invention may be practised otherwise than as specifically described.

What is claimed is:

1. A vane compressor comprising:

a rotary shaft;

a rotor secured on said rotary shaft for rotation in unison therewith, said rotor comprising a first rotor element and a second rotor element having end faces thereof abutting against each other and integrally joined at an axially central portion of said rotor, said first and second rotor elements comprising generally cylindrical bodies having configurations substantially similar to each other, said first and second rotor elements each having a central through bore forming space extending from an outer end thereof along an axis thereof and through which said rotary shaft extends, a plurality of axial slit forming spaces formed in an outer peripheral surface thereof in a circumferentially spaced arrangement and extending along a whole length thereof, a back pressure chamber forming space intersecting with said central through bore forming space and opening in an inner or joining end face thereof, said back pressure chamber forming space having a diameter larger than that of said central through bore forming space, said plurality of axial slit forming spaces having axially central portions thereof communicating with said back pressure chamber forming space, and a plurality of cavity forming spaces formed between adjacent ones of said axial slit forming spaces and opening in an inner end face thereof, said plurality of cavity forming spaces communicating with said back pressure chamber forming space;

a plurality of vanes movably received in said axial slit forming spaces; and a housing within which said rotor and said vanes are arranged, said housing cooperating with said rotor and said vanes to define pump working chambers therebetween;

said first and second rotor elements each being formed of a sintered alloy compact and being integrally joined in axial alignment by means of brazing with at least one brazing member applied on said first and second rotor elements at a joining portion thereof.

2. The vane compressor of claim 1, wherein said at least one brazing member comprises an annular member interposed between said abutting end faces of said first and second rotor elements.

3. The vane compressor of claim 2, wherein said annular member comprises an annular sheet member.

* * * * *